United States Patent [19]

Dom et al.

[11] Patent Number: 4,942,796

[45] Date of Patent: Jul. 24, 1990

[54] STOCK FEED APPARATUS FOR FORGING MACHINES AND THE LIKE

[75] Inventors: Harry A. Dom; John A. Maistros, both of Tiffin, Ohio

[73] Assignee: The National Machinery Company, Tiffin, Ohio

[21] Appl. No.: 228,004

[22] Filed: Aug. 3, 1988

[51] Int. Cl.[5] ..... B26D 5/24; B26D 7/06

[52] U.S. Cl. ..... 83/72; 83/80; 83/206; 83/241; 83/259; 83/277; 83/282; 83/360; 83/734

[58] Field of Search ..... 83/206, 244, 245, 241, 83/247, 273, 277, 263, 369, 360, 72, 73, 80, 259, 282, 734

[56] References Cited

U.S. PATENT DOCUMENTS

| | | | |
|---|---|---|---|
| 3,267,500 | 8/1966 | McClellan . | |
| 3,456,474 | 7/1969 | McClellan et al. | 72/203 |
| 3,701,301 | 10/1972 | Gudmestad | 83/277 |
| 3,712,163 | 1/1973 | Vinson | 83/206 |
| 3,857,313 | 12/1974 | Endo | 83/277 |
| 4,044,588 | 8/1977 | Haines | 72/337 |
| 4,182,206 | 1/1980 | Millar et al. | 83/277 |

*Primary Examiner*—Hien H. Phan

*Attorney, Agent, or Firm*—Pearne, Gordon, McCoy & Granger

[57] ABSTRACT

A stock feed and cutter system for forging machines and the like in which stationary grippers and linearly movable grippers alternately grip rod or wire stock. The movable grippers reciprocate toward and away from the stationary grippers and operate to feed the stock without slippage a precise distance into a cutter. A stock gage is therefore not required and an optimum cutter structure can be provided even for very short workpieces. After each feed operation, the cutter shears a workpiece from the end of the stock, which is subsequently formed to a desired shape. A running adjustment is provided for the reciprocating grippers so that the machine operator can adjust the length of the workpiece produced while the machine is running. A short blank detector independently measures the length of stock being fed and is connected to cause rejection of such short blank. The grippers operate without slippage and, in cooperation with the cutter, produce very uniform workpieces.

18 Claims, 6 Drawing Sheets

STOCK FEED APPARATUS FOR FORGING MACHINES AND THE LIKE

BACKGROUND OF THE INVENTION

This invention relates generally to forging machines, and more particularly to a novel and improved proved stock feed apparatus for feeding elongated stock to a cutter which cuts workpieces of uniform length from the end of the stock.

PRIOR ART

It is common practice to supply elongated rod or wire stock to forging machines, and to provide such machines with a cutter which shears workpieces from the end of the stock. In such machines, the workpieces are subsequently forged in one or more operations to the required shape.

Generally in the past, a pair of opposed feed rolls engaged opposite sides of the stock and were intermittently driven to feed the stock through the shear until the forward end of the stock engaged a stock gage. Such stock gages are positioned relative to the shear plane of the cutters so that the desired length of stock required to produce the workpiece is fed past the shear plane. When the cutter operates, a workpiece of required length is cut from the stock. Generally, the workpieces are ejected from the cutter into a transfer system which transfers the workpieces to one or more work stations in which tools and dies form the workpiece to the desired shape.

In order to ensure that a full size workpiece is provided in such machines, it is necessary to operate the feed rolls so that the stock always engages the stock gage. The practice has therefore been followed to adjust the feed rolls so that they attempt to overfeed to some extent. This ensures that the stock actually engages the stock gage, and also results in some slippage between the feed rolls and the stock as the feed rolls continue to operate after further feeding is prevented by engagement between the stock gage. Examples of such stock gage apparatus are illustrated in U.S. Letters Pat. Nos. 3,267,500; 3,456,474; and 4,044,588. Such feed roll stock gage system often does not reliably produce workpieces of precisely uniform length. Typically, the stock gage must be located in a very congested area of the forging machine, and cannot be structured with complete rigidity. Consequently, variations in the deflection of the stock gage occurs when the force of engagement of the stock against the stock gage is changed, due to variations in the effective gripping of the stock by the feed rolls as they slip during the overtravel.

Further, when producing short workpieces, the stock gage must be positioned very close to the shear plane. In such cases, the cutter usually cannot be structured to provide optimum support for the workpieces during the shearing operation. This also introduces variations in the size of the workpieces that are cut from the stock.

The prior art also includes machines providing a feed system which combines a fixed gripper and a movable gripper mounted on a lever for arcuate movement. Such machines do not employ a stock gage. The fixed gripper in such machines holds the stock while the movable grippers moves to its gripping position, and then releases the stock for feeding until the movable gripper completes its feeding of the stock. In such machines, the grippers are operated so that the stock is gripped by at least one gripper at all times so that full control of the stock is provided.

Because the movable gripper is carried by a lever and moved along an arc, the feed of such system has been used only to produce relatively short workpieces. Further, the grippers of such machines have been operated by piston and cylinder actuators controlled by a timing valve. Consequently, the cyclic rate of the machine and its output rate are quite limited.

SUMMARY OF THE INVENTION

In accordance with the present invention, a novel and improved stock feed workpiece cutter apparatus is provided. Such apparatus provides more accurate feeding so that workpieces of very accurate size are produced. The apparatus does not require a stock gage, so a cutter structure can be used which provides optimum shearing operation and more uniform workpieces.

Further the apparatus provides powered running adjustment of the feed which can be controlled from the operator's console in a very precise manner. The apparatus also provides independent measurement of the length of the feed for automatic rejection of workpieces of incorrect length.

Still further, feed grippers are employed which provide substantial gripping length and avoid all slippage with the stock. With this structure, substantial gripping forces can be applied to eliminate slippage without marking the surface of the stock. Such positive non-slip gripping of the stock ensures accurate feeding. The gripping force is applied by spring pressure so that any variation in the size of the stock does not result in significant changes in the gripping force.

The apparatus provides a fixed gripper and a linearly movable gripper which are timed in operation by cam-driven linkages so that the gripping of the two grippers overlaps to maintain positive control of the stock during each entire cycle of operation. Because the movable gripper moves with linear motion, the apparatus can be employed to feed substantial distances for the production of relatively long workpieces.

Because the grippers are operated by mechanical cam-driven linkages, high cyclic operating speeds can be achieved.

Further, the actual feeding operation is powered by a rigid cam drive linkage, so positive feeding is provided substantially without linkage deflection, which could introduce feeding inaccuracies.

The apparatus also provides a simple power feed stop which locks the movable gripper in its open or release position, and locks the fixed gripper in its gripped position so that the operator can interrupt the feeding operation at any time without stopping the machine.

The illustrated embodiment of the invention provides a fixed gripper and a movable gripper mounted on a linearly movable gripper carriage for reciprocating motion toward and away from the fixed gripper. Three cams are mounted on a single camshaft. One cam powers an adjustable lever system which drives the gripper carriage in its reciprocating motion. A second cam operates the fixed gripper, and a third cam operates the movable gripper. Because the three cams are on a single camshaft, precise timing is provided even at high cyclic speeds.

The fixed gripper grips the stock at the end of the feed stroke before the movable gripper releases the stock. The fixed gripper then continues to grip the stock while the movable gripper releases the stock and retracts to its gripping position for a subsequent feeding operation. After the movable gripper is fully retracted, it grips the stock prior to the release of the fixed gripper. Thereafter, while the fixed gripper is released, the movable gripper advances and feeds the stock the precise distance of its movement. With this timing, the grippers maintain complete control of the stock during the entire feed cycle. Further, since the grippers operate without slippage on the stock, each workpiece is precisely uniform in length.

Because the feed system does not require a stock gage, the cutter is provided with full support for the stock on both sides of the shear plane, even when short workpieces are required. Therefore, very uniform shearing operations are performed.

The drive linkage for reciprocating the movable gripper is located in a relatively uncongested portion of the machine, and is structured for very high rigidity. Therefore, deflections to the drive linkage are virtually nonexistent, and precise feeding is achieved.

Further, the drive linkage is fully adjustable even while the machine is running, and such adjustment is powered and controlled from the operator's console. Further, a feedback signal provides a readout for the operator indicating the length of feed. The apparatus also provides independent measurement of the length of the stock fed during each cycle of operation that provides verification of the length of stock being fed, and operates to automatically eject workpieces of incorrect length.

Because slippage between the stock and the feed grippers is eliminated, wear is minimized and a highly reliable apparatus is provided.

These and other aspects of this invention are illustrated in the accompanying drawings, and are more fully described in the following specification.

DETAILED DESCRIPTION OF THE DRAWINGS

Figure 1:
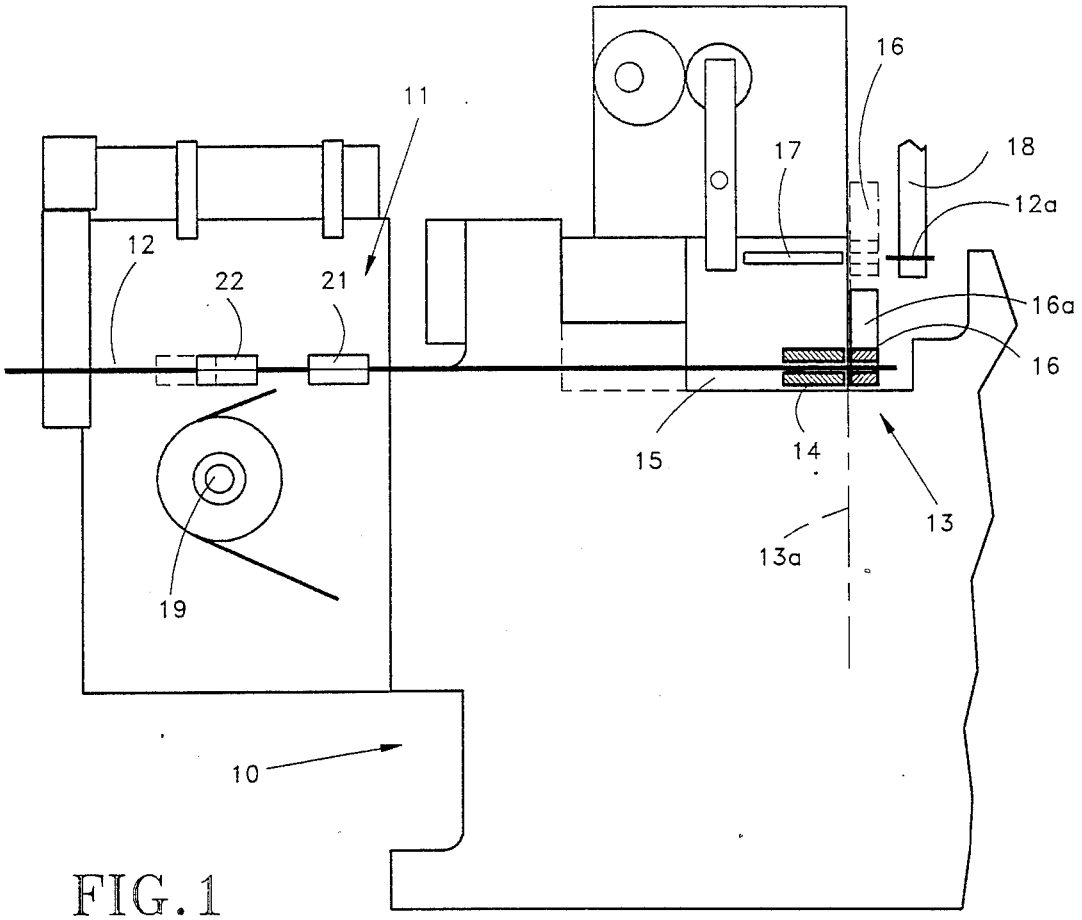
FIG. 1 is a fragmentary vertical cross section of a progressive former incorporating a stock feed in accordance with this invention, schematically illustrating the path of the stock as it moves through the feed apparatus to the cutter.

FIG. 1 schematically illustrates the portion of a progressive former through which stock passes to the cutter of the machine. The overall machine is described and illustrated in copending applications for Letters Pat. Ser. No. 190,175, filed May 4, 1988 now U.S. Pat. No. 4,910,993 both of which are assigned to the assignee of this invention. Both of these applications are incorporated herein in their entirety to provide a description of the structure and operation of the overall machine. However, it should be understood that the present invention is also applicable to other types of forging machines which forge workpieces cut from rod or wire stock.

The machine includes a frame assembly 10 on which the stock feed apparatus 11 is mounted. Lengths of rod or wire stock 12 are alternately gripped by stationary grippers 21 and reciprocating grippers 22 which operate to intermittently move the stock through the stock feed to a cutter 13.

The cutter 13 includes a fixed tubular quill 14 mounted on the die breast 15 of the machine and a movable, tubular quill 16 carried by a pivotally mounted cutter lever 16*a* between the position illustrated in full-line in alignment with the fixed quill 14 and a raised position indicated in phantom in alignment with an ejector pin 17.

During the feeding operation of the stock 12 caused by the reciprocating gripper 22, as described in detail below the forward end of the stock 12 is moved through the stationary quill 14 past the shear plane 13*a* of the cutter into the movable quill 16. The distance the stock extends past the shear plane 13*a* determines the length of the workpiece 12*a* sheared from the end of the stock as the movable quill 16 moves up from its position in alignment with the stationary quill into alignment with a cam-driven ejector pin 17.

While the movable quill is maintained in alignment with the ejector pin 17, the ejector pin is moved forward and ejects the workpiece from the movable quill into the transfer 18 of the machine. Thereafter, the transfer moves the workpiece to the work stations of the machine, where it is formed to the desired shape.

Because the stock feed apparatus feeds the stock through a precise distance during each cycle, a stock gage is not required and the two quills can be shaped and sized to provide optimum shearing operations. Normally, such optimum shearing operation is accomplished when the two quills have a full tubular structure which closely fits the stock and provides full support for the stock on both sides of the shear plane 13*a*.

Figure 2:
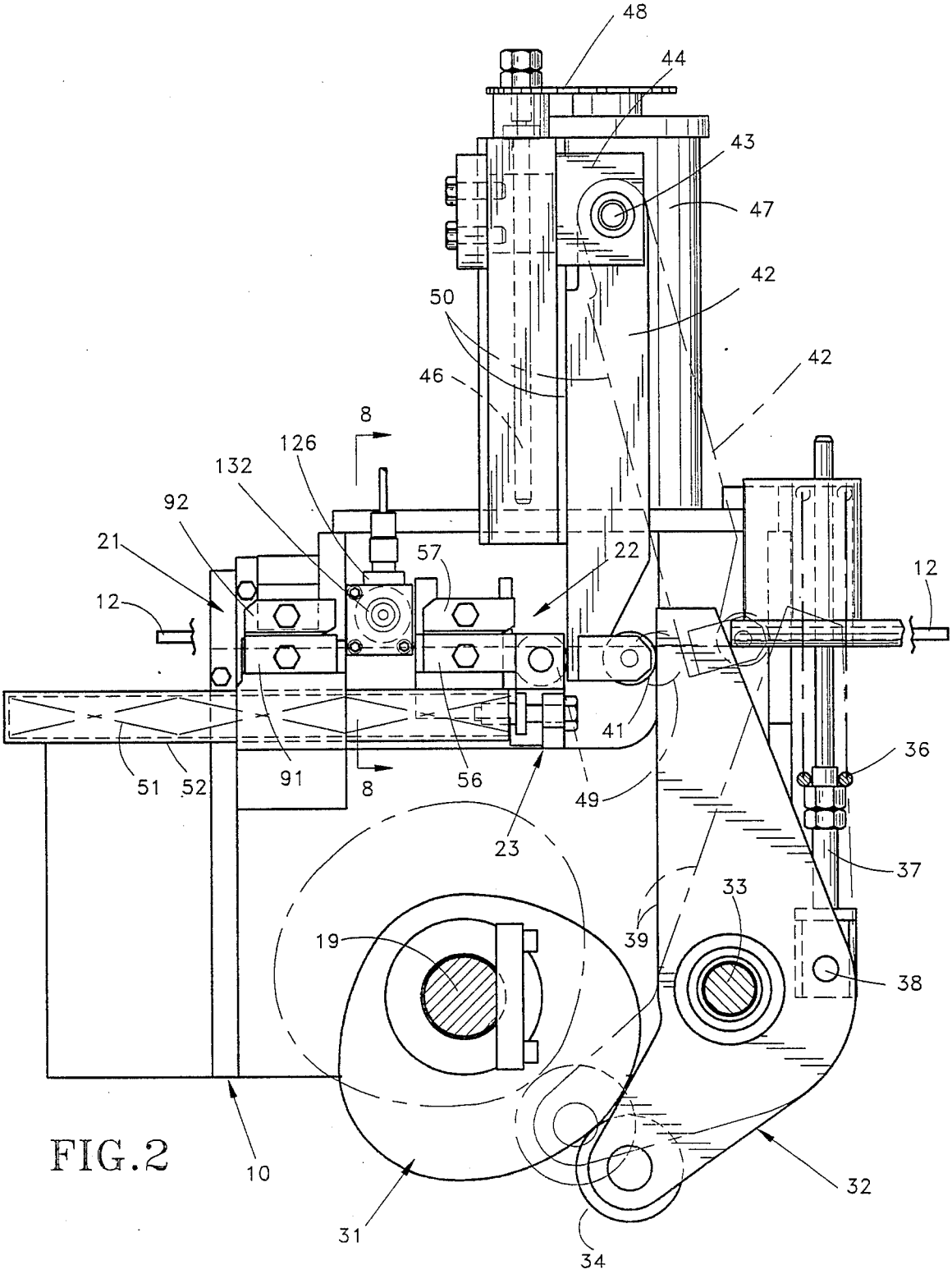
FIG. 2 is a fragmentary side elevation illustrating the adjustable drive linkage for reciprocating the movable gripper of the stock feed apparatus in a position of a adjustment producing a substantial feed stroke.

Referring to FIG. 2. mounted on the frame 10 is the pair of stationary grippers 21 and the pair of movable or reciprocating grippers 22. The reciprocating grippers 22 are mounted on a carriage 23, best illustrated in FIG. 3. Support for the carriage in its reciprocating movement is provided by three fixed rods 24, 26, and 27 supported on the frame 10. A bearing 28 on the carriage encircles the rod 24 for longitudinal movement along the rod. The carriage also provides a roller 29 which is positioned between the two fixed rods 26 and 27. The bearing 28 functions to guide the carriage for its longitudinal movement, and the roller positioned between the rods 26 and 27 prevents rotation of the carriage around the axis of the rod 24. Therefore, the carriage is supported and guided for straight-line reciprocation.

Referring again to FIG. 2, the carriage is provided with an adjustable cam-driven linkage to control the reciprocating movement thereof. Such linkage includes a cam 31 mounted on the camshaft 19. The camshaft is driven by the main drive of the machine, as best illustrated in the copending applications, supra, and rotates in timed relation to the drives of the various components of the machine.

A rocker arm 32 is journaled on the frame 10 for oscillating rotation about a pivot shaft 33 and provides a cam follower 34 which engages the periphery of the cam 31. A compression spring 36 positioned around a push rod 37 pivotally connected at 38 to the rocker arm 32 operates to provide a resilient force urging the rocker arm 32 in a clockwise direction, as viewed in FIG. 2, and operates to maintain the cam follower 34 in engagement with the cam 31. Rotation of the cam 31 operates to oscillate the rocker arm 32 back and forth through a fixed angle of rotation between the fixed full-line position and the fixed phantom-line position of FIG. 2.

The rocker arm provides a drive or operating surface 39 which extends vertically in the full-line position and is engaged by a cam follower 41 carried by an adjustable lever 42 at its lower end. The upper end of the adjustable lever 42 is connected by a pivot 43 to an adjustable carriage 44. The carriage 44 is supported on the frame 10 for vertical movement, and is threaded onto a screw 46 journaled on the frame and held against vertical movement relative to the frame. A control motor 47 is connected by a chain drive 48 to the screw 46 to power the screw and adjust the carriage 44 and lever 42 vertically. Such adjustment changes the stroke of the carriage 23, and thereby changes the length of stock fed during each cycle of operation.

Figure 2A:
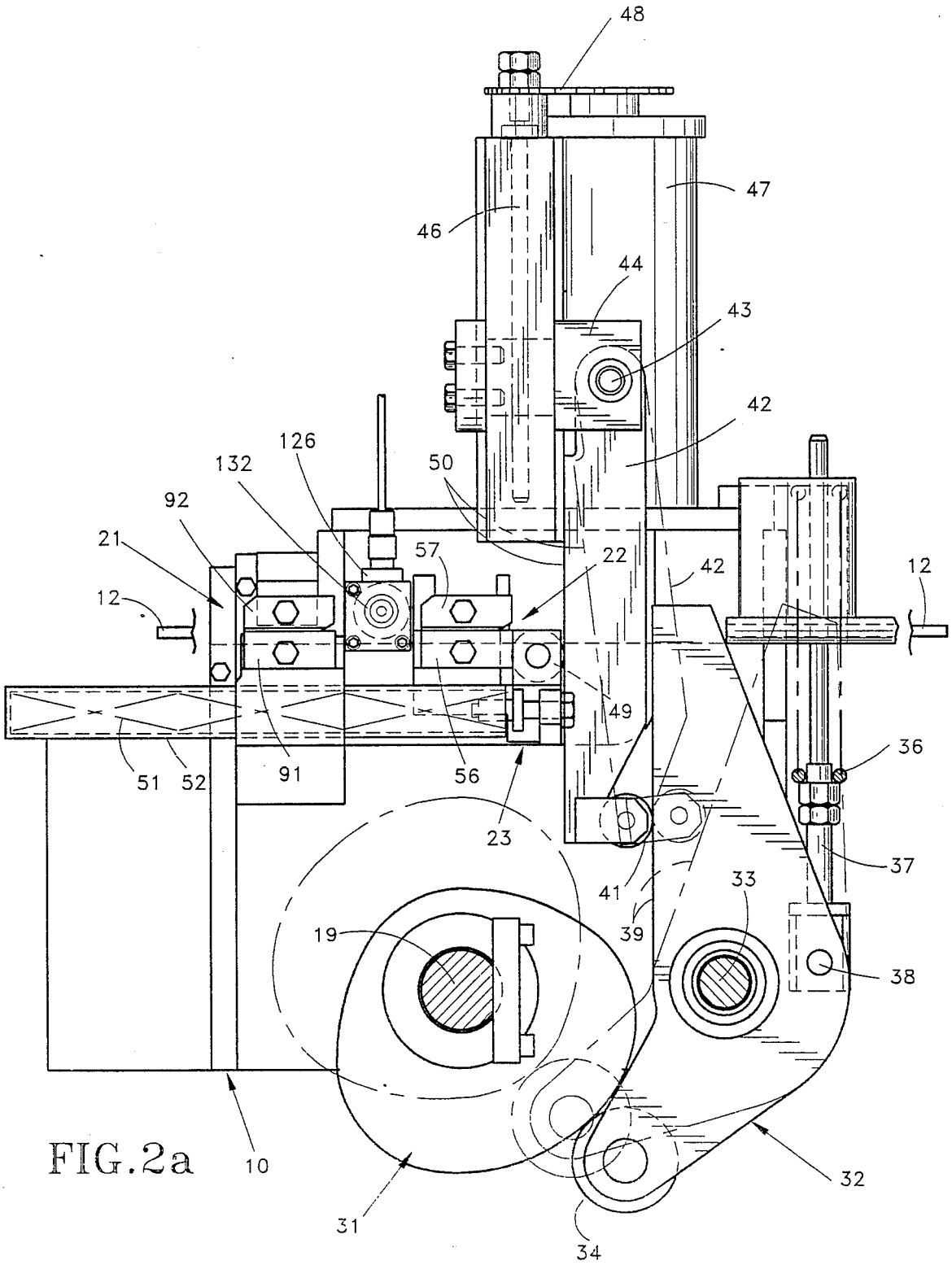
FIG. 2*a* is a fragmentary side elevation similar to FIG. 2, illustrating the linkage in an adjusted positioning a smaller feed stroke.

The drive surface 39 extends in a direction parallel to the movement of the carriage 44 when the rocker arm 32 is in the maximum position of anticlockwise motion illustrated in full-line in FIGS. 2 and 2*a*. Therefore, adjustment of the position of the carriage 44 and the lever 42 does not change the rotational position of the lever 42 at the end of the feed operation. Vertical adjustment of the lever 42, however, changes the position of the lever 42 in the phantom-line position of the rocker arm, which is the position in which the reciprocating grippers initially grip the stock prior to the feeding operation. For example, as illustrated in FIG. 2, when the lever 42 is in the uppermost position, it engages the drive surface 39 at a point substantially spaced from the pivot 33 and a substantial feed stroke is provided. On the other hand, when the lever 42 is adjusted downwardly, as illustrated in FIG. 2*a*, until the cam follower 41 is substantially adjacent to the pivot 33, a relatively short feed stroke is provided.

The reciprocating carriage 23 provides a roller 49 journaled thereon which is held in engagement with a drive surface 50 by springs 51 contained in a guide tube 52 mounted on the frame 10. The drive surface 50 is also parallel to the direction of movement of the carriage 44 when the rocker arm is in the full-line position at the end of a feed stroke. Therefore, the adjustment of the carriage 44, and in turn the lever 42, does not alter the position of the reciprocating carriage at the end of the feed stroke. It does, however, change the length of the stroke by changing the position of the carriage in its gripping position prior to each feed stroke.

With this lever system, the machine operator can make running adjustments of the length of feed of the stock during each cycle of operation. The control motor 47 is preferably a servomotor which can be rotated at the operator's control with small increments of rotation so that the machine operator can make very small adjustment of the feed stroke of the stock feed system. In the illustrated embodiment, the machine operator can adjust the stroke of the stock feed in increments of about 0.1 millimeters throughout the entire range of adjustments provided by the machine.

Figure 3A:
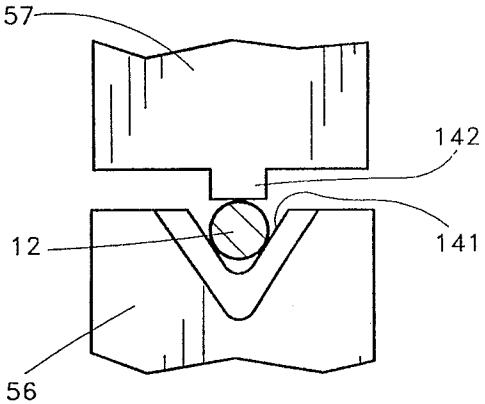
FIG. 3*a* is an enlarged, fragmentary view illustrating one gripper structure.
Figure 3:
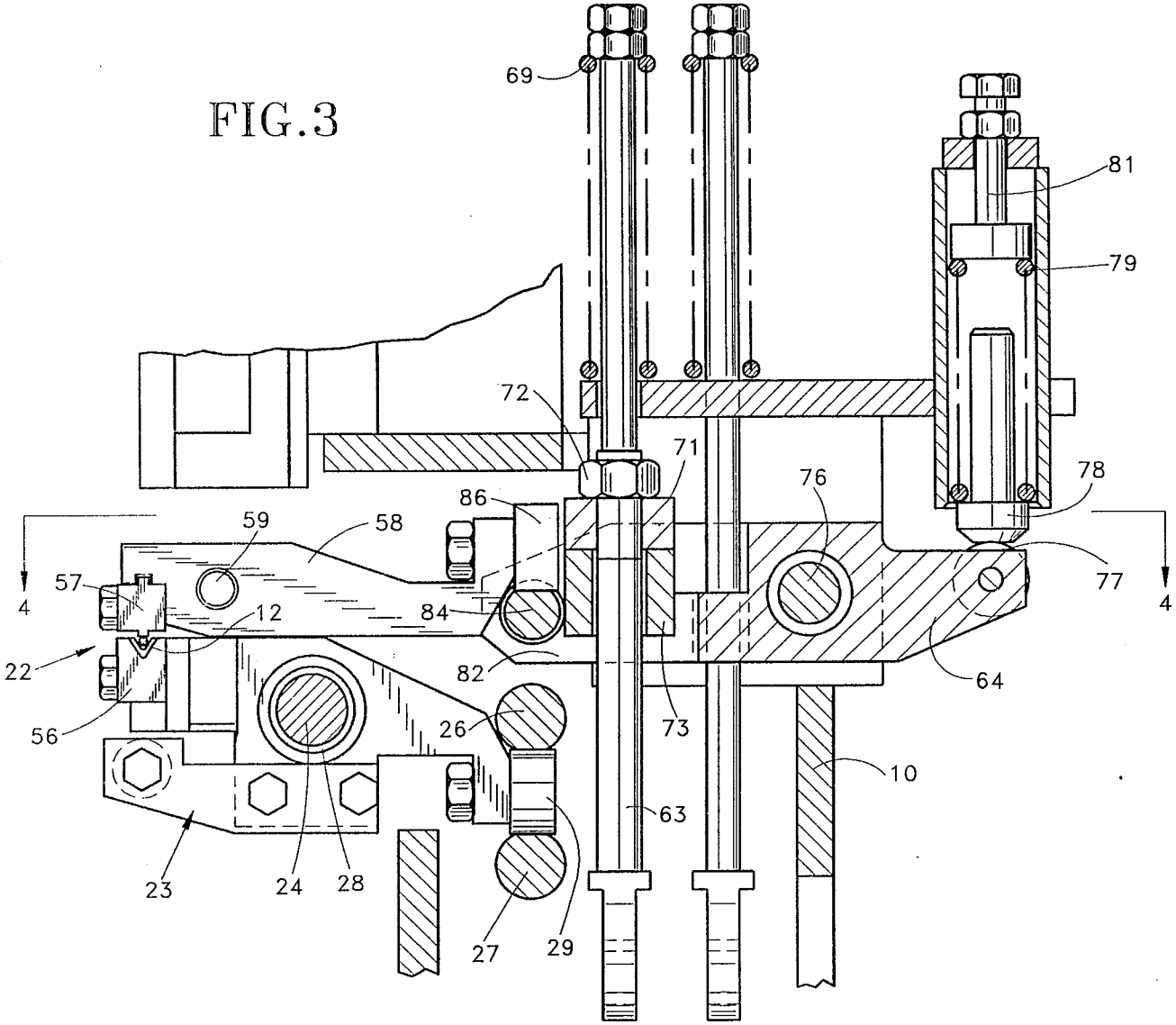
FIG. 3 is a fragmentary side elevation, with parts removed for purposes of illustration, illustrating the reciprocating carriage for supporting the movable gripper and also illustrating the lever system for controlling the operation of the movable or reciprocating gripper.
Figure 4:
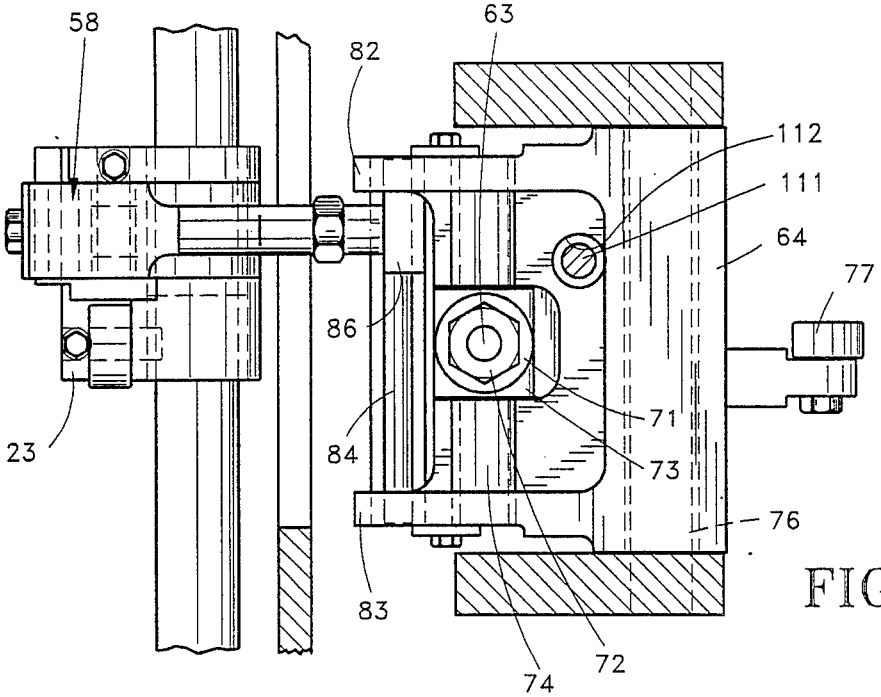
FIG. 4 is a fragmentary plan view, taken generally along line 4—4 of FIG. 3, also illustrating the linkage for the movable gripper.
Figure 5:
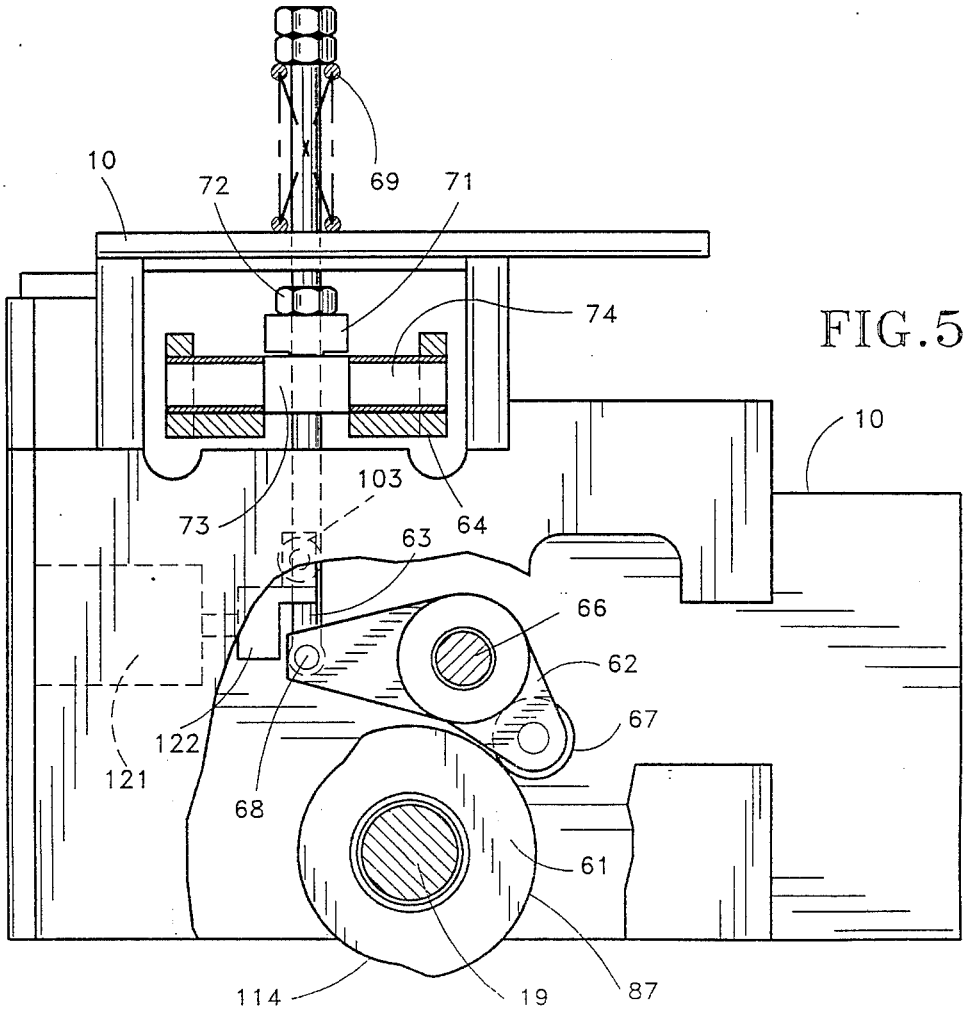
FIG. 5 is a fragmentary view, with parts removed for purposes of illustration, illustrating the cam drive for controlling the opening and closing of the movable gripper.

Referring now to FIGS. 3, 4, and 5, the reciprocating grippers 22 include a lower or fixed gripper 56 mounted on the carriage 23 for reciprocation therewith. The reciprocating grippers also include a movable gripper 57 carried on a lever 58 pivotally mounted at 59 on the carriage 23. The movable gripper 57 is movable toward the fixed gripper 56 for gripping the stock, and the gripping force is released when the stock is to be released.

The gripping and release of the movable gripper 57 is controlled by a cam 61 (illustrated in FIG. 5) mounted on the camshaft 19 through a linkage including a rocker arm 62, a rod 63, and a lever 64. The rocker arm 62 is mounted on a pivot 66 and provides a cam follower 67 which engages the cam 61. The rod is pivotally connected to the rocker arm at 68 and provides a compression spring 69 at its upper end which biases the rocker arm 62 in a clockwise direction as viewed in FIG. 5 to maintain the cam follower 67 against the cam 61. A bearing block 71 is adjustably positioned on the rod 63 by a nut 72 and engages a second bearing block 73 carried by a shaft 74 mounted on the lever 64.

Referring now to FIGS. 3 and 4, the lever 64 is mounted on the frame 10 by a pivot 76 and provides a roller 77 engaged by a plunger 78 pressed by a spring 79 in a downward direction, as viewed in FIG. 3. This applies a spring bias to the lever 64 urging such lever 64 in a clockwise direction as viewed in such figure. The force of the spring 79 is adjusted by an adjusting screw 81.

Referring now to FIG. 4, the lever 64 provides a pair of spaced arms 82 and 83 which journal the ends of a rod 84 to provide a track parallel to the direction of movement of the carriage 23. Journaled on the rearward end of the lever 58 is a roller 86 which is carried back and forth along the rod or track 84 by the reciprocation of the carriage 23. Consequently, when the lever 64 is rotated in a clockwise direction (as viewed in FIG. 3) by the spring 79, the rod 84 is raised and, through engagement with the follower 86, causes anticlockwise rotation of the lever 58, which moves the movable gripper 57 toward the fixed gripper 56 and causes the stock 12 to be gripped between the two grippers 56 and 57. The force of gripping is determined by the adjusted force of the spring 79. Because the track or rod 84 is parallel to the direction of movement of the carriage, the movement of such carriage does not affect the gripping of the grippers 22.

Release of the grippers 56 and 57 occurs when the follower 67 engages the outer dwell portion 87 of the cam 61. Such engagement produces anticlockwise rotation of the rocker arm 62 and causes the rod 63 to move the bearing block 71 in a downward direction as viewed in FIG. 5 to cause anticlockwise rotation of the lever 64 to release the spring-produced clamping force of the movable gripper 57. Preferably, the grippers are formed as best illustrated in FIG. 3*a*, with a V-groove 141 in one gripper and a projection 142 on the other gripper so that the grippers can function well even when the stock size is changed significant amounts. Such grippers provide three lines of contact engaging the periphery of the stock, and because these lines of contact are relatively long slippage between the stock and the grippers is completely avoided.

With this mechanism, the gripping of the reciprocating grippers is positively released by the operation of the cam 61 and the force of gripping is determined by the adjustable force of the spring 79. Therefore, any variations in the diameter of the stock being fed into the machine do not materially affect the gripping force of the reciprocating gripper 22. Further, the movement of the carriage back and forth does not affect the gripping force applied by the spring 79.

With this structure, the gripping force is applied and released in timed relationship to the operation of the machine and is not altered by the length of the feed stroke of the carriage 23. Further, because the grippers move with straight-line movement, the feed stroke of the stock feed system can be adjusted through substantial distances without affecting the operation of the grippers.

Figure 6:
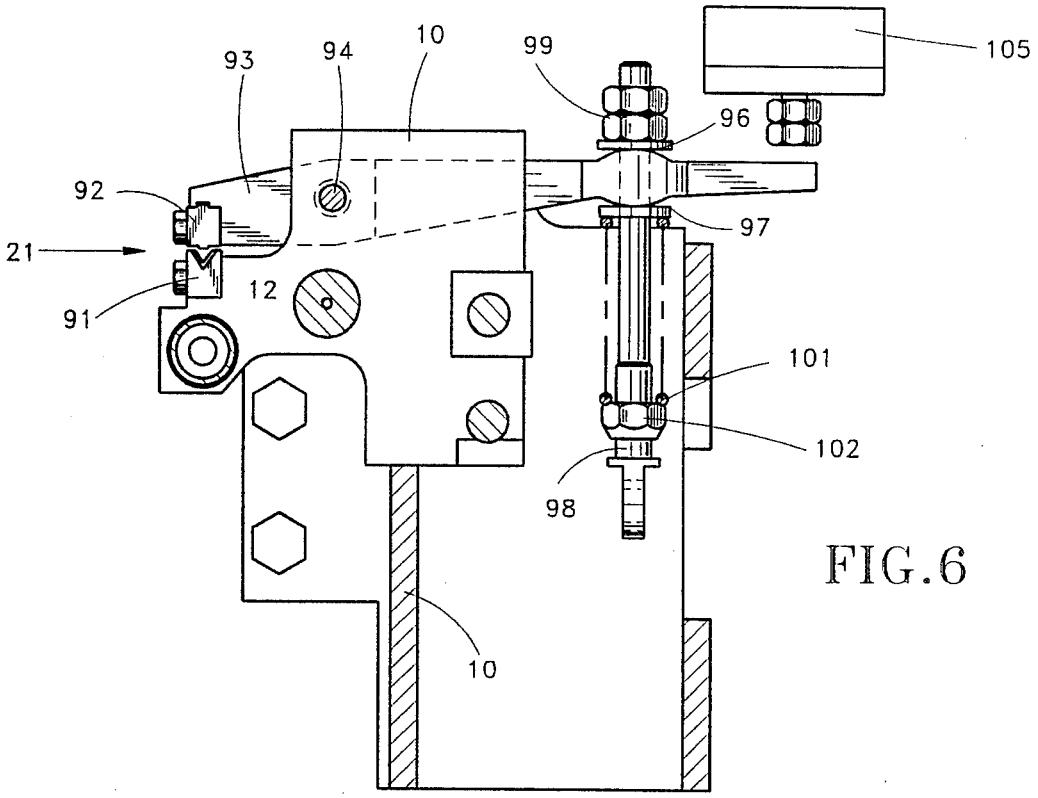
FIG. 6 is a fragmentary side elevation, parts removed for purposes of illustration, illustrating the linkage for the fixed or stationary gripper.
Figure 7:
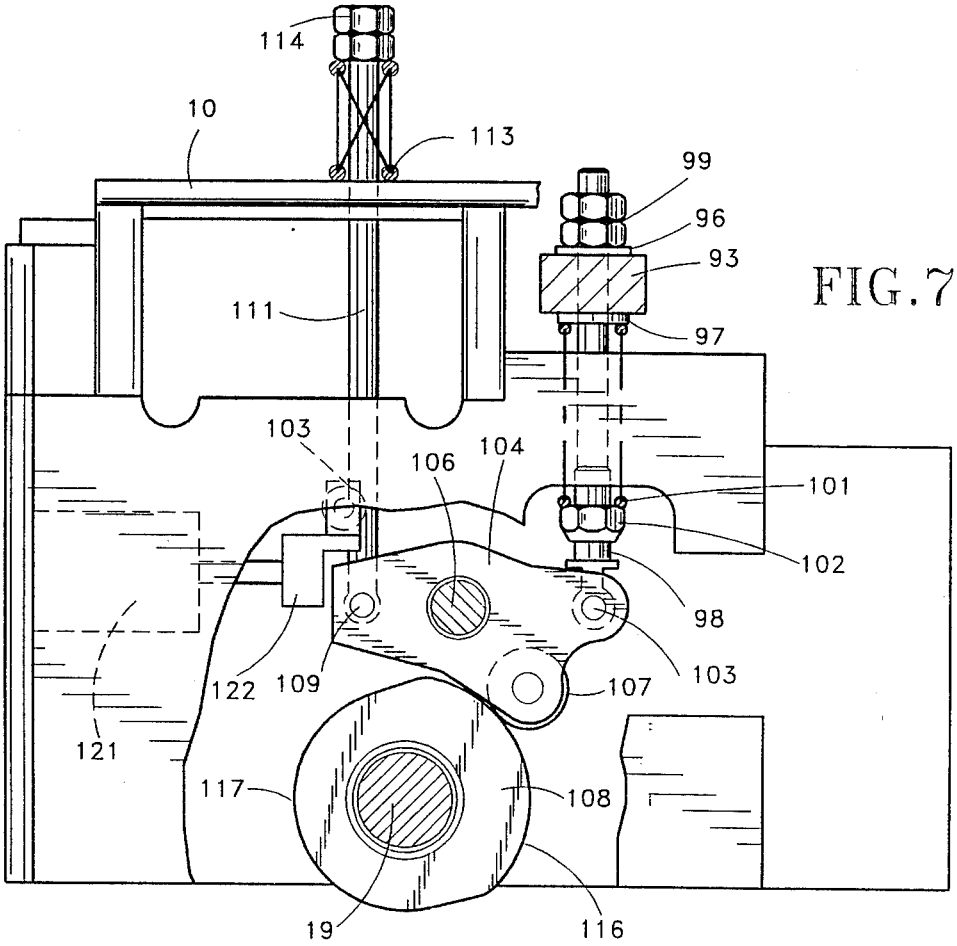
FIG. 7 is a fragmentary side elevation, illustrating the cam drive for controlling the operation of the fixed gripper.

The mechanism for operating the stationary grippers 21 is best illustrated in FIGS. 6 and 7. The stationary grippers 21 include a fixed gripper 91 mounted on the frame 10 against all movement relative thereto. Positioned immediately above the fixed gripper 91 is a movable gripper 92 carried by a lever 93 supported on the frame 10 by a pivot 94. The opposite end of the lever extends between a pair of thrust washers 96 and 97 carried by a rod 98.

The position of the thrust washer 96 on the rod 98 is determined by a pair of jam nuts 99 and the thrust washer 97 is resiliently held against the lever 93 by a compression spring 101 which extends between the thrust washer 97 and an adjusting nut 102 on the rod 98.

The lower end of the rod 98 is connected by a pivot 103 to a rocker arm 104 supported on the frame by a pivot 106. Mounted on the rocker arm 104 is a cam follower 107 which engages the periphery of a cam 108 mounted on the camshaft 19. Pivotally mounted on the end of the rocker arm 104 opposite the pivot 103 by a pivot 109 is a rod 111 which extends up through a clearance opening 112 formed in the lever 64 (illustrated in FIG. 4). A compression spring 113 extending between the frame 10 and jam nuts 114 on the rod 111 produces a spring bias on the rocker arm 104 maintaining the follower 107 in engagement with the cam 108.

When the follower 107 engages the outer dwell portion 116 of the cam, the rocker arm rotates in an anticlockwise direction as illustrated in FIG. 7. Such movement lifts the rod 98 and produces anticlockwise rotation of the lever 93 (as viewed in FIG. 6) until it grips the stock. Overtravel is provided so that the force of the spring 101 establishes a spring-biased gripping force, causing the movable gripper 92 to clamp against the stock 12. The gripping force is adjustable by adjusting the position of the adjusting nut 102. An actuator 105 (illustrated in FIG. 6 is provided to engage the rearward end of the lever 93 and open the stationary grippers 21 when stock is initially fed into the machine. However, in normal operation, the actuator 105 is not operated.

Here again, the gripping force of the stationary grippers 21 is established by a spring so that variations in diameter of the stock do not materially alter the gripping force. However, when the cam 108 rotates to a position in which the follower engages the inner dwell portion 117, the spring 113 causes clockwise rotation of the rocker arm 104 in a clockwise direction, as viewed in FIG. 6. This causes the rod 98 to be lowered, returning the thrust washer 96 into engagement with the lever 93 and produces clockwise rotation of the lever 93, as viewed in FIG. 6, to release the gripping by the movable gripper 92.

The timing of the two grippers is positively established by the shape of the two cams 61 and 108. These cams are sized and shaped so that the stationary grippers 21 close and grip the stock immediately after the reciprocating carriage 23 completes the feeding operation under the influence of the cam 31. The gripping of the stationary grippers occurs before the reciprocating grippers release. After the reciprocating gripper is released by the operation of the cam 61, the cam 31 allows the reciprocating carriage to move the reciprocating grippers back along the stock a distance equal to the adjusted distance for feeding determined by the position of the lever 42.

When the carriage 23 is moved to the right as viewed in FIG. 2 to its retracted position, the reciprocating grippers are operated by the cam 61 to grip the stock before the stationary grippers are released. Immediately after the reciprocating grippers grip the stock, and while they dwell in their retracted positions, the stationary grippers are released by the cam 108. The cam 31 thereafter commences the feeding of the stock by moving the reciprocating grippers forward to complete a cycle of operation.

Because the movement of the reciprocating grippers and the operation of both the reciprocating grippers 22 and the stationary grippers 21 are controlled by cams mounted on a single camshaft, proper timing is maintained and the stock is gripped by one or the other of the grippers at all times. Therefore, positive control of the stock is achieved and accurate feeding is accomplished. This timing is not changed in any way by the adjustment of the stroke of the feed determined by the position of the lever 42. Therefore, in accordance with this invention, accurate feeding is maintained and running adjustment can be performed throughout the entire range of adjustment of the stock feed system.

If at any time the operator desires to terminate the feeding while continuing the operation of the machine, a stop feed cylinder 121 (illustrated in FIGS. 5 and 7) mounted on the frame 10 is pressurized to extend a stop feed block 122 into engagement with the two rocker arms 62 and 104. A roller 123 mounted on the frame 10 engages the other side of the stop feed block so that the forces of the springs 69 and 113 cannot produce clockwise rotation of either of the rocker arms 62 or 104. The stop feed block holds such rocker arms in the position in which the stationary grippers 21 remain gripped and the reciprocating grippers 22 remain in their released position.

Figure 8:
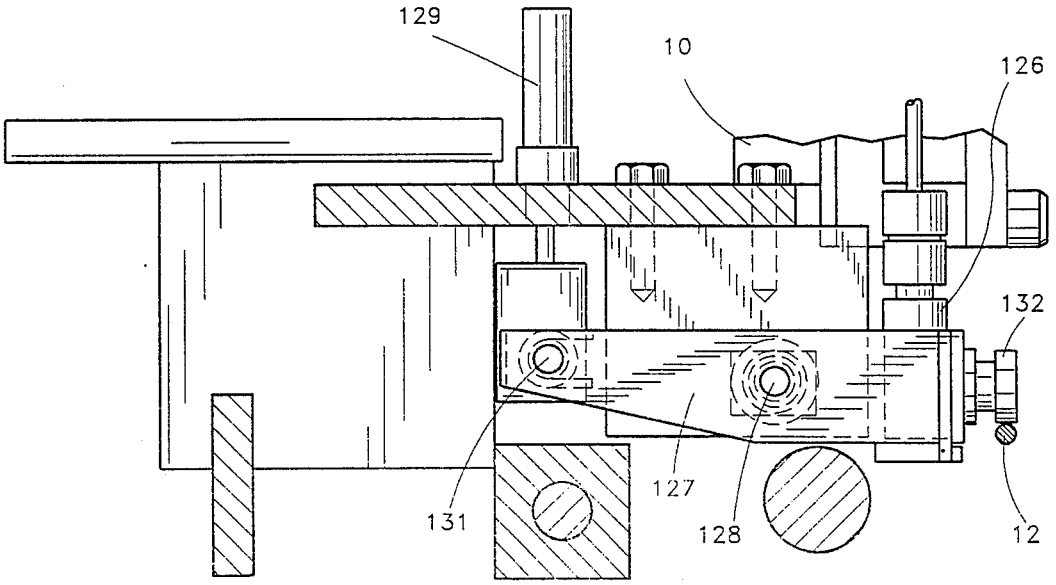
FIG. 8 is a fragmentary, vertical section taken generally along line 8—8 of FIG. 2, illustrating the support for the signal generator which provides independent measurement of the length of stock feed.

A short blank detector provides independent measurement of the distance the stock is actually fed. It includes a pulse counting signal generator 126, illustrated in FIGS. 2 and 8. The signal generator is supported by a lever 127 mounted on the frame 10 by a pivot 128. A piston and cylinder actuator 129 is connected to the rearward end of the lever 127 by a pivot 131 and is operable to press a measuring wheel 132 against the stock.

The signal generator operates to generate an electrical signal which is a function of the rotation of the measuring wheel 132 caused by the movement of the stock during the feed cycle. This signal is transmitted to the operator's console and provides the machine operator with a visual indication of the actual amount of stock fed during each cycle of operation. The signal generator is also connected to the control for the transfer of the machine so that workpieces of incorrect length are automatically dropped before they are transferred to the various work stations of the machine.

With the present invention, precise feeding of the stock is achieved, since slippage is not encountered. The two grippers 21 and 22 provide sufficient length of contact with the stock to prevent all slippage with the stock. Therefore, the amount of stock fed during each cycle of operation is exactly equal to the travel of the reciprocating grippers 22. Therefore, a stock gage is not required.

Because the stock feed apparatus is located in a relatively uncongested area of the machine, the levers 42 and 44 can be and are sized for substantially complete rigidity under the loading conditions encountered. Therefore, variations in deflection of the stock feed system are virtually non-existent and accurate stroking of the reciprocating grippers 22 is achieved.

Because a stock gage is not required, an optimum cutter structure can be provided which normally includes full quills for maximum support of the stock on each side of the shear plane.

Although the preferred embodiment of this invention has been shown and described, it should be understood that various modifications and rearrangements of the parts may be resorted to without departing from the scope of the invention as disclosed and claimed herein.

What is claimed is:

1. A cyclically operable stock feed apparatus for forging machines and the like which intermittely feeds predetermined lengths of elongated stock to a cutter for shearing workpieces having said predetermined length from said stock, comprising a frame, a fixed gripper on said frame, a movable gripper on said frame movable with straight-line movement through a stroke one end of which provides a gripping position and the other end of which provides a release position, and cam drive means operating to cycle said movable gripper between said positions and to open and close said grippers in timed relationship, said cam drive means including:

(a) a firs cam drive moving said movable gripper through said stroke back and forth between said gripping and release positions;

(b) a second cam drive for controlling said movable gripper so that it is released while said movable gripper moves from said release position to said gripping position;

(c) a third cam drive for controlling said fixed gripper so that it is released while said movable gripper is moving from said gripping position to said release position for feeding stock;

(d) said cam drives operating in timed relationship and being timed so that at least one of said grippers is closed to grip said stock during the entire time of each cycle to maintain complete control of the positions of said stock; and (e) measuring means operating to independently measure the length of stock fed during each cycle of said stock feed apparatus.

2. A stock feed apparatus as set forth in claim 1, wherein said first cam drive is adjustable to change the length of said stroke and the distance between said gripping position and said release position while said feed apparatus is operating.

3. A stock feed apparatus as set forth in claim 1, wherein said first cam drive is adjustable to change the distance between said gripping position and said release position without changing the location of said release position.

4. A stock feed apparatus as set forth in claim 1, wherein said movable grippers are mounted on a carriage, and said carriage is mounted on said frame for straight-line reciprocation.

5. A stock feed apparatus as set forth in claim 4, wherein said movable gripper includes a first gripper element mounted on said carriage and fixed against movement relative thereto, and a second gripper element mounted on a first lever pivoted on said carriage, said second cam drive including a second lever pivoted on said frame for pivotal movement about an axis parallel to said straight-line movement providing a track extending parallel to said straightline movement, said first lever providing a follower movable back and forth along said track with said carriage, pivotal movement of said second lever determining the pivotal position of said first lever independent of the movement of said carriage.

6. A stock feed apparatus as set forth in claim 5, wherein each cam drive includes a cam, and said cams are all mounted on a single camshaft for rotation therewith.

7. A stock feed apparatus as set forth in claim 1, wherein said first drive includes a rocker arm pivoted on said frame for oscillating rotation through a predetermined angle between predetermined first and second positions, said rocker arm providing a straight first operating surface extending in a predetermined direction when said rocker arm is in said first position, a lever pivoted on a carriage movable in said predetermined direction and providing a first follower engaging said first operating surface, said lever providing a second straight operating surface extending in said predetermined direction when said rocker arm is in said first position, said movable gripper including a second follower engaging said second operating surface to reciprocate said movable gripper through a distance determined by the position of said carriage supporting said lever.

8. A stock feed apparatus as set forth in claim 7, wherein power means are connected to move said carriage through increments of movement producing changes in the distance said movable gripper moves in increments in the order of 0.1 millimeters.

9. A stock feed apparatus as set forth in claim 7, wherein said apparatus includes independent measuring means operating to measure the length of stock fed during each cycle.

10. A stock feed apparatus as set forth in claim 1, wherein springs are connected to cause gripping of said grippers and said cams operate to release said grippers.

11. A stock feed apparatus as set forth in claim 1, including a shear operating in timed relation to said stock feed apparatus for cutting workpieces from said stock during each cycle.

12. A forgoing machine having means to produce separate workpieces from elongated stock comprising a frame, a stationary gripper on said frame for intermittently gripping stock, a carriage on said frame reciprocable toward and away from said stationary grippers through a stroke having a length equal to the length of said workpieces, movable grippers on said carriage movable therewith toward and away from said stationary grippers operable to intermittently grip said stock, and cam-operated drives operable to:

(a) move said carriage through a predetermined distance from a gripping position to a release position;

(b) operate said stationary grippers to grip stock while said carriage is in said positions and while said carriage moves from said release position to said gripping position;

(c) operate said movable grippers to grip stock while said carriage is in said positions and while said carriage moves from said gripping position to said release position, and a cutter operable to cut said workpieces from the end of said stock while said stationary grippers grip said stock; and (d) three cams mounted on a single camshaft to corotate in timed relationship, a first of said cams operating to move said carriage, a second of said cams operating said stationary grippers, and a third of said cams operating said movable grippers.

13. A forgoing machine as set forth in claim 12, wherein a mechanical linkage is associated with each of said cams connected to operate said grippers and said carriage, said linkage associated with said third cam including separate elements mounted on said frame and on said carriage, the operation of said elements being unaffected by carriage movement.

14. A forgoing machine as set forth in claim 13, wherein said linkage associated with said first cam is adjustable to adjust the distance said carriage moves between said gripping position and said release position, without changing said release position.

15. A forgoing machine as set forth in claim 14, wherein said linkage associated with said first cam is sufficiently rigid to prevent material deflections thereof under the loads applied thereto.

16. A forgoing machine as set forth in claim 13, wherein each linkage associated with said movable grippers and with said stationary grippers includes a cam-driven rocker arm, and a stop feed device is provided with an element operable to engage both of said rocker arms and maintain them in positions maintaining said stationary grippers in a gripped condition and said movable grippers in a released condition.

17. A forgoing machine comprising a frame, a stationary gripper on said frame for intermittently gripping stock, a carriage on said frame reciprocable toward and away from said stationary grippers, movable grippers on said carriage movable therewith toward and away from said stationary grippers operable to intermittently grip said stock, and cam-operated drives operable to:

(a) move said carriage through a predetermined distance from a gripping position to a release position;

(b) operate said stationary grippers to grip stock while said carriage is in said positions and while said carriage moves from said release position to said gripping position;

(c) operate said movable grippers to grip stock while said carriage is in said positions and while said carriage moves from said gripping position to said release position, and a cutter operable to cut workpieces from the end of said stock while said stationary grippers grip said stock;

wherein a stop feed device is provided operable to stop the feeding of stock by locking said stationary grippers in their gripped condition and locking said movable grippers in their released condition.

18. A forgoing machine as set forth in claim 17, wherein an independent measuring apparatus measures the length of stock moved by said movable grippers.

* * * * *

UNITED STATES PATENT AND TRADEMARK OFFICE

CERTIFICATE OF CORRECTION

PATENT NO. : 4,942,796

DATED : July 24, 1990

INVENTOR(S) : Harry A. Dom et al.

It is certified that error appears in the above-identified patent and that said Letters Patent is hereby corrected as shown below:

Column 1, line 7, delete "proved".
line 41, "engagement between the stock gage" should read --engagement between the stock and the stock gage--.
Column 3, line 58, "one gripper structure" should read --one preferred gripper structure--.
Column 9, line 53, "firs" should read --first--.
Column 11, line 1, "forgoing" should read --forging--.
line 28, "forgoing" should read --forging--.
line 35, "forgoing" should read --forging--.
Column 12, line 1, "forgoing" should read --forging--.
line 5, "forgoing" should read --forging--.
line 13, "forgoing" should read --forging--.
line 36, "forgoing" should read --forging--.

Signed and Sealed this

Twenty-first Day of January, 1992

*Attest:*

HARRY F. MANBECK, JR.

*Attesting Officer*

*Commissioner of Patents and Trademarks*